US007739944B2

(12) United States Patent
Ante et al.

(10) Patent No.: US 7,739,944 B2
(45) Date of Patent: Jun. 22, 2010

(54) FLUID OPERATED ROTARY DRIVE

(75) Inventors: Christian Ante, Esslingen (DE); Gerhard Thorwart, Filderstadt (DE)

(73) Assignee: Festo AG & Co. KG, Esslingen (DE)

( * ) Notice: Subject to any disclaimer, the term of this patent is extended or adjusted under 35 U.S.C. 154(b) by 378 days.

(21) Appl. No.: 11/922,174

(22) PCT Filed: Feb. 15, 2007

(86) PCT No.: PCT/EP2007/001298

§ 371 (c)(1),
(2), (4) Date: Dec. 11, 2007

(87) PCT Pub. No.: WO2007/118538

PCT Pub. Date: Oct. 25, 2007

(65) Prior Publication Data

US 2009/0205486 A1 Aug. 20, 2009

(30) Foreign Application Priority Data

Mar. 31, 2006 (DE) ..... 20 2006 005 174 U

(51) Int. Cl.
*F15B 15/12* (2006.01)
*F15B 15/24* (2006.01)

(52) U.S. Cl. ..... 92/13.41; 92/121

(58) Field of Classification Search ..... 92/13, 92/13.41, 32, 106, 121
See application file for complete search history.

(56) References Cited

U.S. PATENT DOCUMENTS 2,793,623 A * 5/1957 Ludwig et al. ..... 92/12
3,362,300 A * 1/1968 Shafer ..... 92/13
5,622,096 A * 4/1997 Granberg ..... 92/120
5,732,613 A * 3/1998 Stoll et al. ..... 92/121
2002/0152886 A1 * 10/2002 Sawdon ..... 92/13.41

FOREIGN PATENT DOCUMENTS

| | | | |
|---|---|---|---|
| DE | 195 11 488 | A1 | 10/1996 |
| DE | 19511488 | A1 * | 10/1996 |
| DE | 199 34 279 | A1 | 2/2001 |
| JP | 9-317710 | | 12/1997 |
| WO | WO 99/14506 | | 3/1999 |

* cited by examiner

*Primary Examiner*—Thomas E Lazo
(74) *Attorney, Agent, or Firm*—Hoffman & Baron, LLP

(57) ABSTRACT

A fluid operated rotary drive comprises a drive housing (2) and an output shaft (4) able to be caused to oscillate in relation to it and having a pivotal abutment arranged on it which cooperates with a counter abutment (34 and 35). The pivotal abutment is able to be positioned about the longitudinal axis (8) of the output shaft (4) in different abutment settings and is able to be clamped in a releasable manner respectively against a clamping face (56) on the housing by means of a clamping means (53). The counter abutment (34 and 35) has an anchoring structure comprising at least one anchoring projection and opposite to it there is an anchoring face extending at least for some distance about the longitudinal axis (8) of the drive shaft and prior to initial fitting of the at least one counter abutment (34 and 35) being smooth, the anchoring structure being able to bite into the anchoring face on clamping the counter abutment (34 and 35) with the formation of at least one recess structure (61) having an anchoring recess (65).

24 Claims, 4 Drawing Sheets

FLUID OPERATED ROTARY DRIVE

This application claims priority based on an International Application filed under the Patent Cooperation Treaty, PCT/EP2007/001298, filed Feb. 17, 2007 and German Application No. DE202006005174.0, filed Mar. 31, 2006.

BACKGROUND OF THE INVENTION

The invention relates to a fluid operated rotary drive comprising a drive housing and an output shaft able to be driven in relation to it by fluid force to perform a reciprocating rotary movement about its longitudinal axis and furthermore a pivotal abutment kinematically coupled with the output shaft and cooperating with at least one counter abutment extending into its path of pivoting for limiting the angular movement of the output shaft in an adjustable manner, said counter abutment being able to be positioned around the longitudinal axis of the output shaft in different abutment positions and able to be clamped in a releasable manner there against a clamping face of the housing, said clamping face extending at least for some distance about the longitudinal axis of the output shaft.

A rotary drive of this type as disclosed in the German patent publication DE 195 11 488 C2 comprises two counter abutments arranged in an adjustable fashion on an arcuate guide on the housing for a pivotal abutment rotationally locked with the output shaft. The counter abutments may be set in different abutment positions by clamping means along the outer periphery of the output shaft to set the angular position of the output shaft as is required. Owing to the clamping means a frictional connection with the drive housing is possible because the respective counter abutment may be held against a clamping face on the housing.

Normally the frictional locking of the counter abutments suffices to prevent undesired slipping out of the set abutment position. More especially in the case of security-related applications there is however a requirement for an even more reliable locking of the counter abutments offering an increased degree of security as regards slipping out of position.

The German patent publication DE 199 34 279 B4 discloses, in conjunction with a positioning abutment in linear drive, the provision of mutually complementary rack-like tooth means on the one hand on the housing and on the other hand on the respective abutment which are able to be meshed with each other in different positions. Though such gear tooth means may also be employed in a rotary drive—see for example the patent publication WO 99/14506 A1—owing to the curved shape necessary a great degree of complexity is involved. Furthermore the engagement of teeth means that there is no stepless positioning of the abutments.

SUMMARY OF THE INVENTION

One objective of the present invention is to propose measures in connection with a fluid operated rotary drive which offer an increased degree of security as regards slipping out of position of the counter abutment or abutments.

In order to attain this aim there is a provision such that the at least one counter abutment has an anchoring structure with at least one anchoring projection there being opposite such structure an anchoring face which extends at least for some distance about the longitudinal axis of the output shaft and which prior to initial fitting of the at least one counter abutment is smooth and into such anchoring face the anchoring structure may bite on clamping the counter abutment with the formation of a permanent recess structure having at least one anchoring recess.

In this manner the at least one counter abutment may be fixed in the desired abutment position not only frictionally but also in an interlocking fashion as well. This means additional security against slipping out of position, more particularly in the case of impact forces of the pivotal abutment and/or any gradual weakening of the clamping forces. This enhanced security may be ensured relatively economically seeing that it is possible to do without any prefabricated gear teeth on the housing. When the anchoring recesses in the housing cooperating in producing the interlocking connection are made the first time a counter abutment is clamped fast in the desired abutment position automatically by biting into the anchoring face, which has so far been smooth. This also offers the advantage that at least in the case of the a first locking of a counter abutment in an abutment position a stepless positioning is possible entailing an exact placement.

Further advantageous developments of the invention are defined in the dependent claims.

The at least one anchoring projection able to bite into the clamping face may for example be in the form of a pyramid or a cone. In order to ensure a relatively high load carrying capacity it is however preferred to have recourse to an anchoring tooth extending athwart the curved longitudinal axis of the anchoring face, and the tooth tip may have a linear shape.

It is furthermore an advantage for the anchoring structure of the counter abutment not to have merely a single anchoring projection but rather a plurality of anchoring projections following each other in the direction of the curved longitudinal direction of the anchoring face. Such anchoring projections are preferably placed symmetrically as related to the force transfer portion of the clamping means.

Should several anchoring projections be present it is to be recommended to keep to a relatively large distance apart of neighboring anchoring projections. Such distance should not only be present between the tip portions but also between the root portions where the anchoring projections originate. In the portion between the root sections of two adjacent anchoring projections there is preferably a face parallel to the opposite anchoring face.

In the condition securely held by the clamping means the respective counter abutment preferably has a support face (which is parallel to the clamping face on the housing) firmly braced tight the clamping face. The anchoring structure preferably extends past the support face.

Preferably the anchoring structure so extends away from a base face of the counter abutment that in the condition firmly braced by the clamping means of the counter abutment a free space is left between this base face and the anchoring face opposite to it and has the at least one associated anchoring face extending through it on its engagement with the anchoring face. The free space is more particularly delimited by the counter abutment having its support face coming into engagement with the clamping face and by the base face being set back somewhat at least for some distance in relation to the support face in the direction opposite to the clamping direction. The material shifted by the anchoring structure biting into the anchoring face may be readily deformed into the free space without resistance so that there is no objectionable compaction of the material.

The clamping face is preferably so arranged that as regards the longitudinal axis of the shaft it extends radially without or radially within the anchoring face or, more preferably, it extends on either side of the anchoring face. The latter possibility leads to an optimum supporting action without the counter abutment tending to run askew on tightening up.

Preferably the at least one counter abutment slides at least for some distance on a circularly arcuate guide means extending at least some distance around the longitudinal axis of the output drive shaft. When the clamping means is released it may remain on the guide means and be pushed along into the desired abutment position and steplessly set. The circularly arcuate guide means preferably extends over a center angle of 360 degrees so that there is a complete circle, something which simplifies positioning the counter abutments because they are not obstructed by the housing.

A particularly economic embodiment of the guide means is such that there is a circular superficial recess on the housing open toward to the at least one counter abutment and into which a guide projection on the bottom side of the at least one counter abutment extends axially. When the clamping means is at least slightly slackened off the counter abutment may be set in a direction along the superficial recess while being guided by the radially facing flanks of the recess.

The anchoring face is preferably arranged at a radial distance from the superficial recess so that the anchoring recesses dug in the anchoring face by the anchoring structure end radially short of the superficial recess and do not entail any deformation of the neighboring recess flank. This ensures that sliding of the counter abutment in the superficial recess is not hindered.

Preferably the clamping means will comprise a clamping screw extending through the counter abutment and able to be screwed into a thread secured on the housing. The thread is in particular a component of a clamping nut making engagement in the superficial recess. The clamping screw is preferably so arranged that it extends through any guide projection present.

The component of the pivotal abutment cooperating with the at least one counter abutment is preferably a vane-like abutment arm extending radially away from the output shaft.

In the case of the component, cooperating with the pivotal abutment, of the at least one counter abutment it is preferably a question of an abutment body, which is borne by a main body of the counter abutment, on which the anchoring structure and also any abutment face is formed. The abutment body can be a plain component such as an abutment screw. However it may also be constituted by the housing of a fluid shock absorber, if the counter abutment is fitted with one. In any case it is convenient to arrange the abutment body on the main body in an adjustable fashion so that it may be utilized for performing fine adjustment of the respective abutment angular position of the output shaft.

Should the anchoring structure comprise a plurality of anchoring projections placed consecutively in the direction of the anchoring face, the distance apart of the projections is preferably so chosen that it is not greater the adjustment range of the abutment body. In the case of re-positioning a counter abutment it is therefore possible to so choose a new abutment position that at least one anchoring projection fits into an anchoring recess already pressed into the clamping face without entailing any new anchoring recess being produced. The shifting in position then occurring through one pitch step or distance apart may be bridged over or covered by the adjustable range of the adjustable abutment body. Accordingly on the whole there is the possibility of positioning a counter abutment using a recess structure which has already been dug into the material.

For the tooth producing structure it is preferred to rely on material which is harder than the material of the anchoring face. Here steel is more particularly suitable and in particular hardened steel in conjunction with an anchoring face consisting of aluminum material.

BRIEF DESCRIPTION OF THE DRAWINGS

In the following the invention will be explained in detail with reference to the accompanying drawings.

DETAILED DESCRIPTION OF THE PREFERRED EMBODIMENTS

Figure 1:
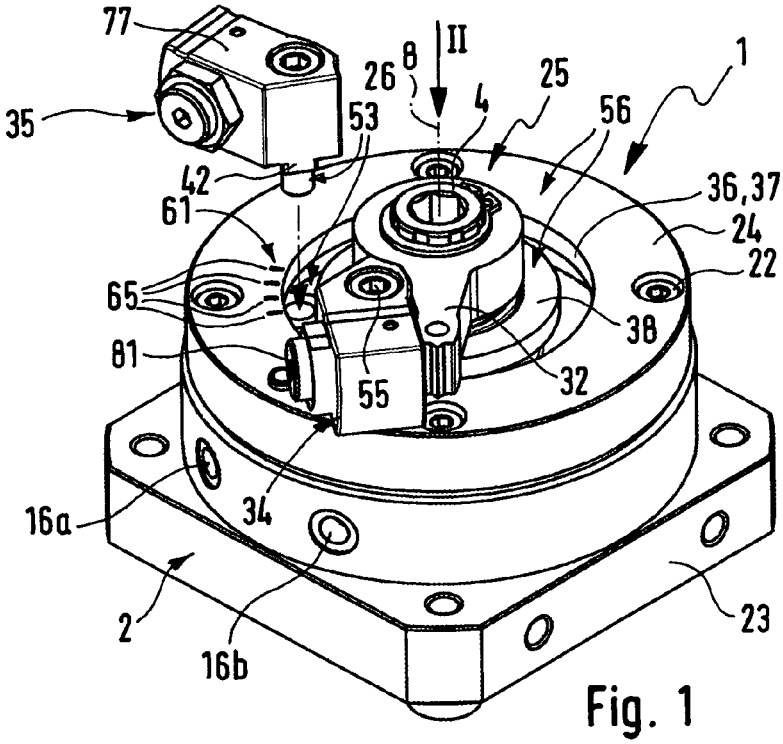
FIG. 1 shows a preferred embodiment of the rotary drive in accordance with the invention in a perspective representation, a counter abutment being illustrated in the installed state and a further counter abutment in the removed state.

The fluid operated rotary drive generally referenced 1 is preferably run on compressed air as a driving medium though it is also suitable for hydraulic driving media.

The rotary drive 1 possesses a housing termed the drive housing 2 in which a peripherally walled-in drive space 3 is formed. On looking in the axial direction it will be perceived that the drive space 3 has a circular cross section.

The drive housing 2 has a drive shaft 4 extending through it in the longitudinal direction of the rotary drive 1. It also extends, more especially centrally, through the drive space 3. By means of bearings 5 in the housing walls 6 and 7 axially delimiting the drive space 3 on either side the output drive shaft 4 is supported for rotation so that it can be turned in relation to the drive housing 2 about its longitudinal axis 8 functioning as an axis of rotation.

The end section, projecting at one axial side (facing downward in the drawing) of the drive housing 2, of the output shaft 4 constitutes an output section 12 able to be connected in a torque transmitting manner with an object to be rotated or pivoted.

The rotary drive 1 of the working example is a so-called oscillating vane or piston drive. As a drive element it comprises an oscillating piston 13 arranged in the drive space 3 and rotationally joined with the output shaft 4. In the present example this piston has a bushing portion 14 provided with internal teeth and fitted in an interlocking manner on the output drive shaft 4 which has a complementary external teeth. Another type of connection, as for example a force fit connection or an integral joint would also be possible.

Figure 3:
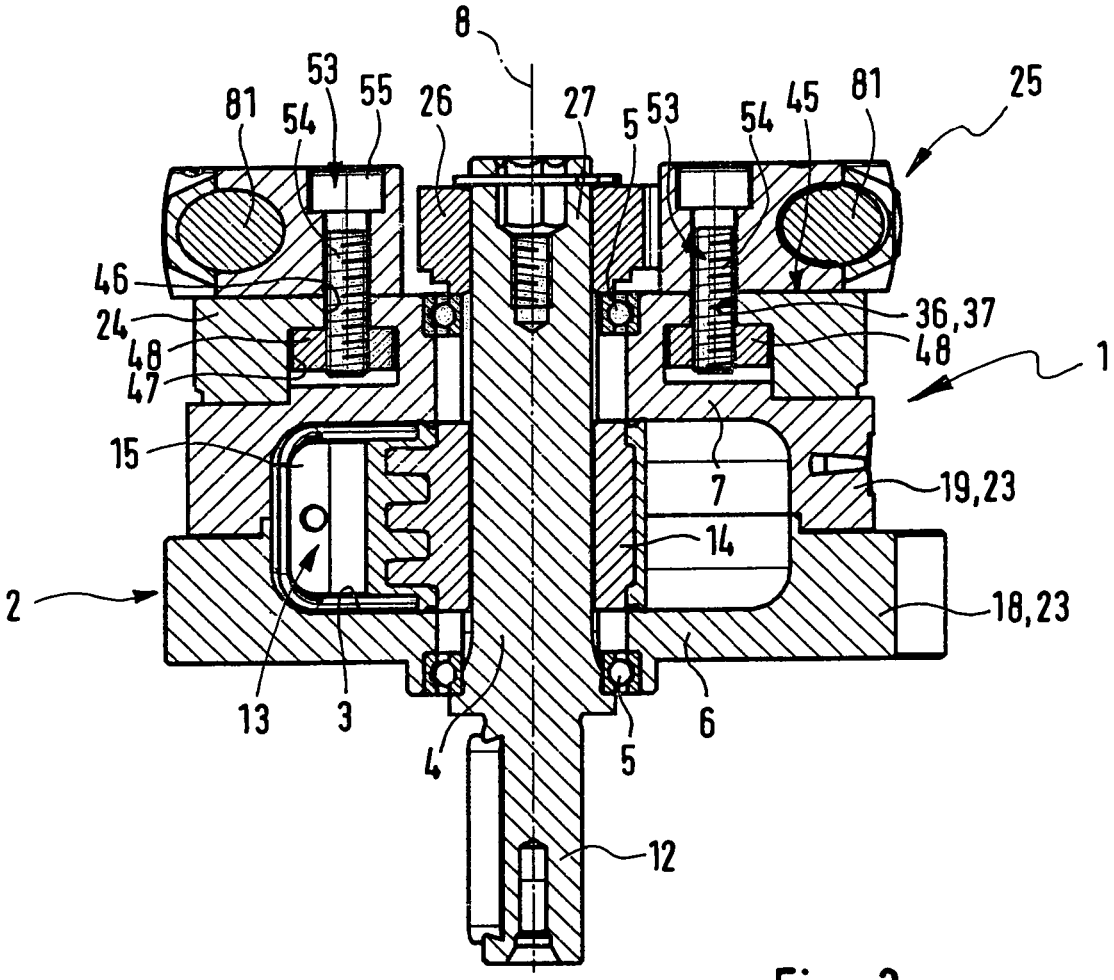
FIG. 3 is a section taken through the rotary drive of FIGS. 2 and 6 on the line III-III in the installed state of the two counter abutments.

A piston space partition, which in FIG. 3 is covered over by the output drive shaft 4, extends into the drive space 3 and is engaged in a sealing manner by the bushing portion 14. Together with an oscillating vane 15, extending radially from the bushing portion 14, of the oscillating piston 13 it divides up the drive space 3 in a sealed fashion into two working spaces, into which a respective fluid duct 16*a* and 16*b* opens which extends through the drive housing 2. By way of the fluid ducts 16*a* and 16*b* the above mentioned drive fluid may be supplied let off in order to drive the oscillating piston 13 in an oscillating movement in the one or the other direction. The result of this is a reciprocating or oscillating rotary movement 18 as indicated by a double headed arrow about the longitudinal axis 8, which accordingly also constitutes an axis of rotation.

Figure 2:
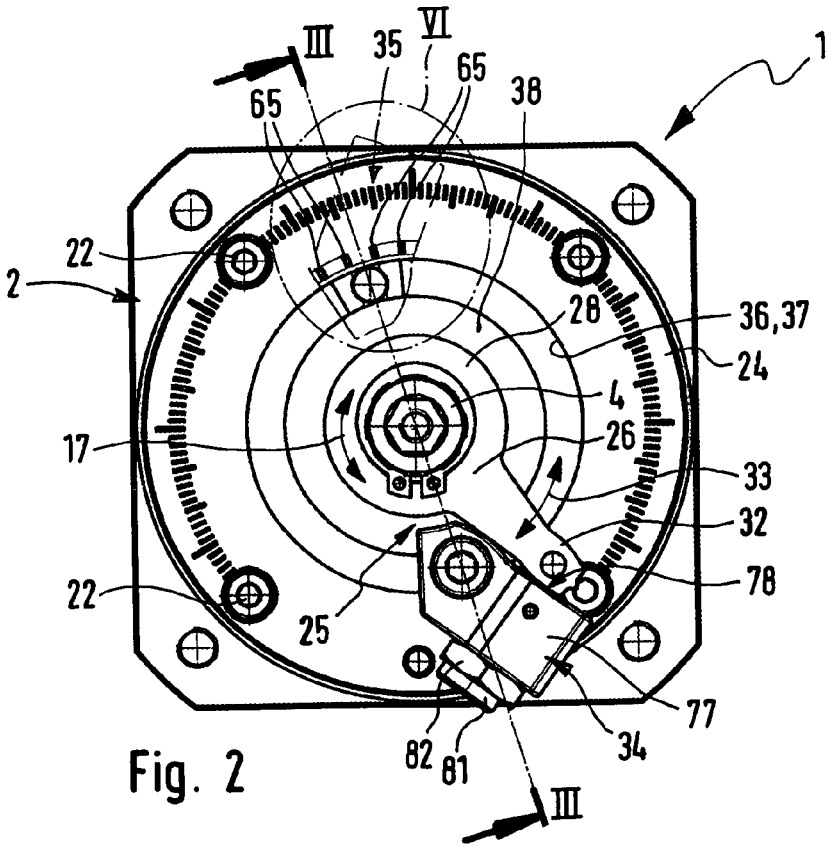
FIG. 2 shows the rotary drive of FIG. 1 in a plan view looking in the direction indicated by the arrow II only the outline of the lifted counter abutment being shown.

For the sake of simple assembly the drive housing 3 in the working example is divided up athwart the longitudinal axis 8 so that there are two axially sequential housing shells 18 and 19 which are screwed together with the intermediate placement of a gasket not illustrated in detail. The screws 22 utilized here are apparent in FIGS. 1 and 2. In each housing shell 18 and 19 there is an axial section of the drive space 3.

The two housing shells 18 and 19 jointly constitute a main body 23 of the drive housing 2. As a further component a ring element 24 is coaxially placed on the housing 2 from the axial side opposite to the output drive section 12. The element is also held by the screws 22.

By a suitable control of the fluid actuation of the oscillating piston 13 the resulting reciprocating rotary movement is available at the output section 12 with a maximum angle of approximately 315 degrees in the working example.

Further details as regards a preferred design of the rotary drive may be found in the said German patent publication DE 195 11 488 C2, which is expressly referred to here.

At its side axially opposite to the output section 12 the rotary drive 1 is provided with an adjustment means generally referenced 25 with which the angular displacement, rendered possible for the output shaft 4, may be set in amount. Acting between the drive housing 2 and the output shaft 4 it sets the angular movement of the output shaft 4 in relation to the drive housing 2 within the maximum possible angular range. Such adjustment means 25 may on the one hand prevent the oscillating piston 13 violently striking the piston space partition placed in the drive space 3 and so being damaged. Furthermore the angular displacement of the output shaft 4 may be adjusted to suit the actual application.

The adjustment means 25 possesses an abutment body termed a pivotal abutment 26 which is connected with an end section 27 protruding from the drive housing 2 of the output shaft 4 in a rotationally locked manner and extends radially from it. Preferably it has a bearing bushing 28 provided with internal teeth and placed on the end section 27, which is provided with complementary external teeth, and axially locked in place. An abutment arm 32 of the pivotal abutment 26 extends like a wing from the bearing bushing 28 and during operation of the rotary drive 1 performs an oscillating movement indicated by the double arrow 33, corresponding to the movement of the oscillating piston 13.

The pivotal abutment 26 may cooperate, in a manner dependent on the direction of oscillation, with one of the two counter abutments 34 and 35. The latter are so arranged on the drive housing 2 that they extend to either side into the oscillation path of the pivotal abutment 26. By means of a circularly arcuate guide 36 provided on the housing (and which extends at least for some distance about the longitudinal axis 8 of the output shaft 4 in the pivoting direction 33) the counter abutments 34 and 35 are guided in the longitudinal direction thereof, such counter abutments also being able to be set steplessly and releasably in different abutment positions in relation to the housing.

The two counter abutment 34 and 35 are preferably mounted for turning on a common guide means 36, which as illustrated may be in the form of a complete ring and extends over a center angle of 360 degrees about the output shaft 4.

Preferably the guide means 36 which is constituted by a groove-like superficial recess 37 open in the axial direction of the longitudinal axis 8, and is on the end face of the drive housing 2 facing the adjustment means 25. In the present example it is defined by an annular intermediate space between a collar-like projection 38 formed on the rear of the housing main body 23 and the ring element 24 arranged on this end face. Each counter abutment 34 and 35 possesses a guide projection 42, extending from its bottom side, fitting into the superficial recess 37 in which it is laterally guided and supported by an inner and an outer flank 43 and 44 of the recess 37. The radially orientated inner and outer faces of the guide projection 42 preferably have the same curvature as the respective flank 43 and 44 cooperating with them. Owing to such guiding engagement the counter abutment 34 and 35 is also prevented from turning about its own axis in relation to the drive housing 2.

Figure 7:
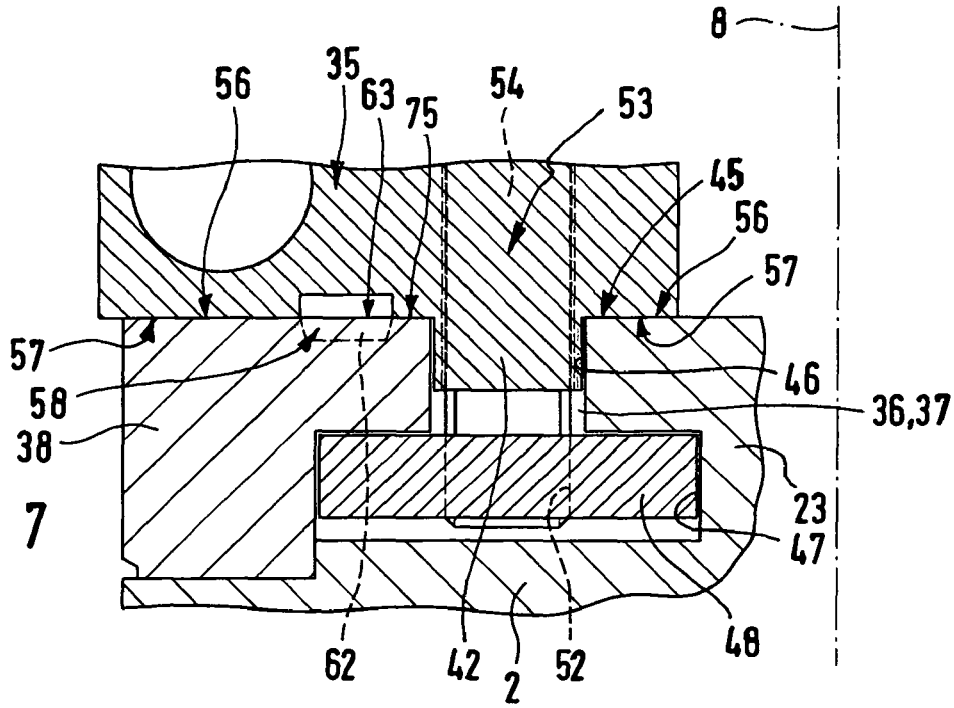
FIG. 7 represents a sectioned view of the rotary drive with a clamped-on counter abutment taken on the section line VII-VII in FIGS. 5 and 6.

FIGS. 3 and 7 show a preferred cross sectional shape for the superficial recess 37. The superficial recess 37 has a neck section 46 which is adjacent to the axially orientated end face 45 of the drive housing 2 and is adjoined by a wider attachment section 47 in the axial depth direction. The guide projection 42 fits into the neck section 46. Within the attachment section 47 a clamping nut 48 is located whose female thread 52 is flush with the neck section 46. Although by virtue of a suitably designed peripheral configuration the clamping nut 48 is locked to prevent rotation within the attachment section 47, it can be shifted in the unlocked state along the superficial recess 37.

The clamping nut 48 is a component of a clamping means generally referenced 53, which serves to releasably set the counter abutment 34 and 35 in the selected abutment position. There is a separate clamping means 53 for each counter abutment 34 and 35.

The clamping means 53 also includes a clamping screw 54 extending through the corresponding counter abutment 34 and 35 parallel to the direction longitudinal axis 8 in a hole 76. This screw has its head 55 bearing against the counter abutment 34 and 35 and is screwed into the female thread 52 of the clamping nut 48. Since the clamping nut 48 axially hooks around the step, present between the neck section 46 and the attachment section 47, of the superficial recess 37, the counter abutment 34 and 35 can be firmly biased by tightening the clamping screw 54 in a direction parallel to the longitudinal axis against the drive housing 2. To alter the abutment position the clamping screw 54 is temporarily slackened off.

The two counter abutments 34 and 35 are able to be adjusted individually and independently of one another. Accordingly the angle of the end position of the drive shaft 4 may be set as desired in both directions of motion. There is however also the possibility of fitting the rotary drive 1 with only one adjustable counter abutment. The angular limitation in the other direction of movement may then for example be brought about using a fixed counter abutment also cooperating with the pivotal abutment 26 or—in the interior of the drive space 3—with the pivotal piston 13 there.

The end face 45 forms a clamping face 56 which as regards the longitudinal axis 8 is both inside and outside the superficial recess 37 radially. It preferably extends in a plane at a right angle to the longitudinal axis 8. Each counter abutment 34 and 35 has a support face 57 at the bottom side facing the drive housing 2, to the side of the guide projection 42. When the clamping means is tightened 53 the support face 57 of the respective counter abutment 34 and 35 is releasably braced against the clamping face 56 to make a frictional connection.

The clamping face 56 extends at least for some distance around the longitudinal axis 8, viz. at least everywhere where a potential abutment position may be located. Preferably the face 56 is a complete 360 degree annular face centered on the longitudinal axis 8. The support face 57 preferably extends in parallelism to the clamping face 56.

In addition to the above described measures responsible for a frictional engagement of the counter abutment 34 and 35 the adjustment means 25 has further features in order to fix the counter abutment 34 and 35 by interlocking in relation to the drive housing 2 in the direction 17 of rotation. These means comprise an anchoring structure 58, formed on the bottom side axially facing the drive housing 2, of the counter abutment 34 and 35, such anchoring structure 58 comprising at least one and preferably several axially extending anchoring projections 62. As considered in the context of a theoretically possible single anchoring projecting 62 several thereof offer the advantage of improved transfer of the forces occurring.

Figure 6:
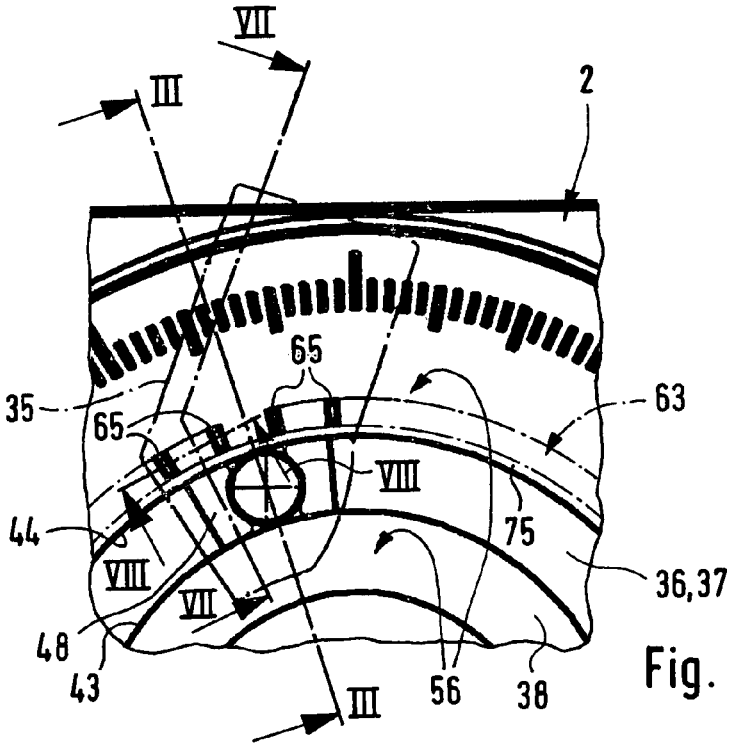
FIG. 6 shows the portion of the structure as in FIG. 2 surrounded in chained lines on a larger scale.

Opposite to the anchoring structure there is on the housing an anchoring face 63 again constituted by the end face 45. This anchoring face extends like the clamping face 56 at least for some distance and preferably annularly in a complete circle around the longitudinal axis 8 of the output shaft 4 while being centered on such longitudinal axis 8. In FIG. 6 the edges of the anchoring face 63 are indicated in chained lines for greater clarity, since the anchoring face 63 in practice preferably merges with the radially adjacent clamping face 56 smoothly. Preferably the clamping face 56 extends both radially outside and also radially inside the anchoring face 63. The said faces 56 and 63 may in particular lie in a common plane.

In the preferred working embodiment the anchoring face 63 is arranged radially without the superficial recess 37 as related to the longitudinal axis 8. As an alternative or in addition an anchoring face 63 could be present as well extending radially within the superficial recess 37, which would then also be opposite to an anchoring structure 58 borne by the counter abutment 34 and 35.

Prior to a counter abutment 34 and 35 being mounted for the first time the anchoring face 63 is smooth. As yet it is free of any recesses cooperating for interlocking anchoring. Each counter abutment 34 and 35 may accordingly be set steplessly about the longitudinal axis 8 in any desired position. This is done in a condition in which the counter abutment 34 and 35 is held with a guiding engagement by the associated clamping means 53 on the guide means 36, while however the clamping means 53 is so far not tightened. Accordingly in this condition of positioning the anchoring projection 62 engage the anchoring face 63 and may slide along it on setting the position of the counter abutment 34 and 35. The support face 57 is in this case still spaced from the clamping face 56.

Figure 9:
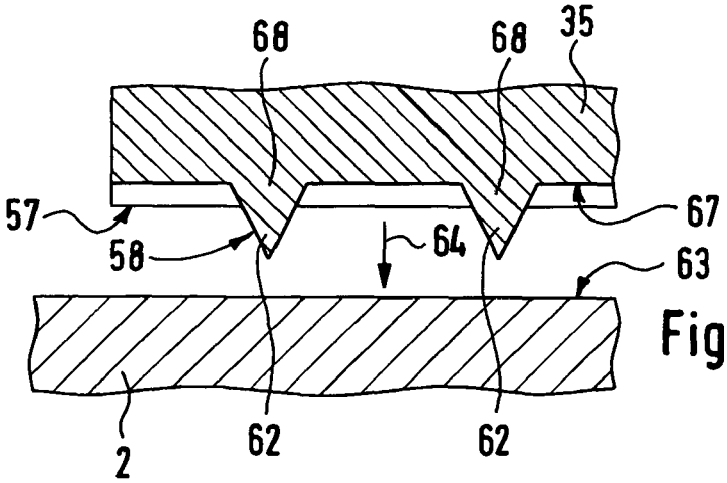
FIG. 9 shows the arrangement of FIG. 8 prior to initial fitting of the counter abutment and to digging in the associated anchoring recesses.

Once the desired abutment position has been found the counter abutment 34 and 35 is clamped by operation of the clamping means 53. The clamping direction applying in this case is indicated in FIG. 9 by the arrow 64. During such clamping the anchoring projections 62 present are thrust into the anchoring face 64, digging into and displacing the material of the housing and producing in each case a permanent anchoring recess 65 in the anchoring face 63 or, respectively, the housing component forming it. These anchoring recesses 65 together constitute a recess structure 61 on the housing.

Accordingly the counter abutment 34 and 35 is meshed with the drive housing 2 and there is an extremely effective supporting action opposing impact forces 66 due to the crashing pivotal abutment 26.

The plurality of anchoring projections 62 are preferably arranged in the (curved) longitudian direction of the anchoring face 63 in sequence on the counter abutment 34 and 35. In the present example there are four such anchoring projections 62 per counter abutment 34 and 35. The anchoring recesses 65 initially produced in the anchoring face 63 by the four anchoring projections 62 on fitting the counter abutment 34 and 35 are to be clearly seen in FIG. 1.

The anchoring projection 62 preferably each have a tooth-like structure with an elongated shape, their longitudinal direction—as clearly indicated in FIG. 6—preferably being radial in relation to the longitudinal axis 8. It is in this manner that there is a particularly large effective engagement face between each anchoring projection 62 and the drive housing 2.

If a counter abutment 34 and 35 is to be shifted in position the clamping means 53 is so slackened off that the counter abutment 34 and 35 may be disengaged from the dug-in recess structure 61 by axially lifting it somewhat to be clear of the drive housing 2. In this lifted condition it may then be shifted along the superficial recess 37 as far as the next desired abutment position, where the procedure described will be repeated by renewed activation of the clamping means 53. The anchoring projections 62 then bite into the anchoring face 63 again to produce new anchoring projections 65.

If a new abutment position is required, the counter abutment 34 and 35 may also only be shifted so far that one or more of its anchoring projections 62 are opposite to an already dug-in anchoring recess 65 so that on clamping up tight a smaller number of anchoring recesses is produced than the number of the anchoring projections 62 present.

If after several changes in position dug in anchoring recesses 65 are present at a plurality of positions on the anchoring face 63, it is possible in the case of further changes in the abutment position—if it is suitable—to even use anchoring recesses 65 which are already present, without its being necessary for new anchoring recesses 65 to be bitten or dug into the material.

Figure 8:
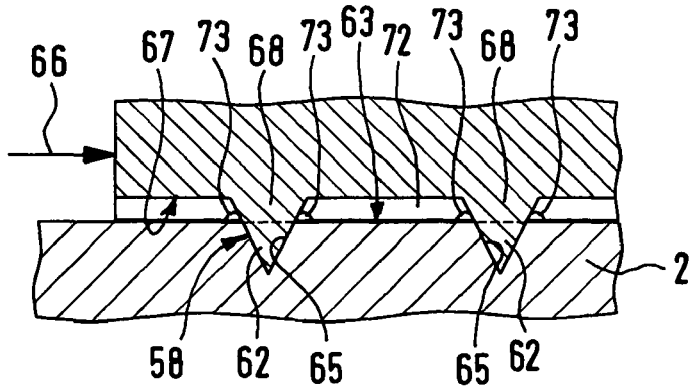
FIG. 8 is a sectioned portion of the rotary drive taken on the section line VIII-VIII in FIGS. 5 and 6.

The anchoring structure 58 extends from a base face 67 on the counter abutment 34 and 35 downward which is preferably set back as regards the adjacent support face 57 in a direction opposite to the clamping direction 64. In other words the tips of opposite foot sections 68 of the anchoring projections 62 come to rest in the counter abutment 34 and 35 at a lower level than the support face 57. This is responsible for a limitation of the depth to which the anchoring projections 62 are bitten or dug into the material. The axial offset of the base face 67 in relation to the support face 57 is made quite clear in FIG. 9. FIG. 8 illustrates this arrangement to indicate that with the counter abutment 34 and 35 clamped a free space 72 is left between the base face 67 and the anchoring face 63 opposite to it for the anchoring projections 63 to extend through. This free space 72 could also be termed a deformation space because it is available for material of the drive housing 2 displaced by the penetrating anchoring projections 62. This is also indicated in FIG. 8 at 73.

In the case of latter repositioning of a counter abutment 34 and 35 the displaced material 73 cannot interfere with the clamping operation because the cooperating supporting and clamping faces 57 and 56 are juxtaposed in relation to the anchoring face 63 and may here still assume a position in which they are flush and superposed without any risk of the counter abutment 34 and 35 running askew, which is to be secured.

Figure 4:
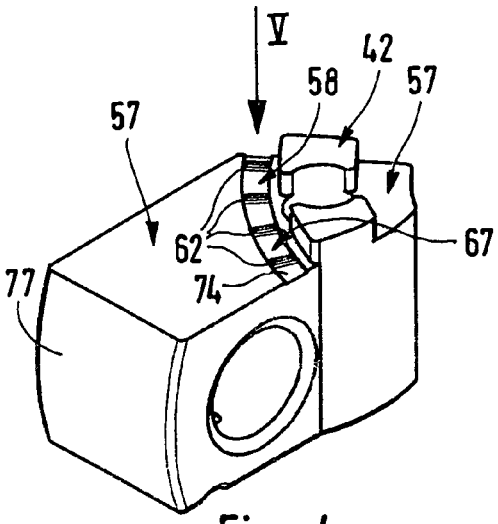
FIG. 4 is a perspective view from below of a counter abutment, only the main body being depicted without the abutment body which is adjustable in this respect.

As shown in FIG. 4 the base face 67 may be the base face of a circularly arcuate groove 74 produced in the counter abutment 34 and 35. The anchoring projections 62 have their foot sections 68 fitting in this groove 74 at a lower level and have their tip section extending proud thereof. Accordingly practically the entire upwardly facing floor face illustrated in FIGS. 4 and 5, of the counter abutment 34 and 35 may function as a support face 57, which is merely interrupted locally by the anchoring structure 58. The groove 74 preferably opens at its end to each side face of the counter abutment 34 and 35.

Preferably the anchoring projection 62 of a respective counter abutment 34 and 35 do not directly adjoin each other. It is an advantage if there is a certain clearance between their foot sections 68, as is made quite clear in FIGS. 8 and 9. The base face 67 can have a face section (which is parallel to the adjacent support face 57) which extends between the foot sections 68.

A convenient arrangement of the anchoring face 63 is depicted in FIGS. 6 and 7. Here the anchoring face 63 is arranged athwart the longitudinal axis 8 of the drive shaft 4 at a radial distance from the opening of the superficial recess 34. Accordingly between the opening of the superficial recess 37 the edge, facing it, of the anchoring face 63 there is a smooth edge face 75 not able to be struck by the anchoring structure 58 and having a certain radial extent. The consequence of this is that the adjoining flank of the neck section 46 is not subject to any deformation by the anchoring projections 62 digging into the anchoring face 36. Accordingly the ability of the guide projection 62 to slide along the superficial recess 37 is not impaired.

Preferably the anchoring structure 58 is made of a material harder than the anchoring face 63. While the latter in the working example is of aluminum, the anchoring structure 58 is preferably made of hardened steel.

Figure 5:
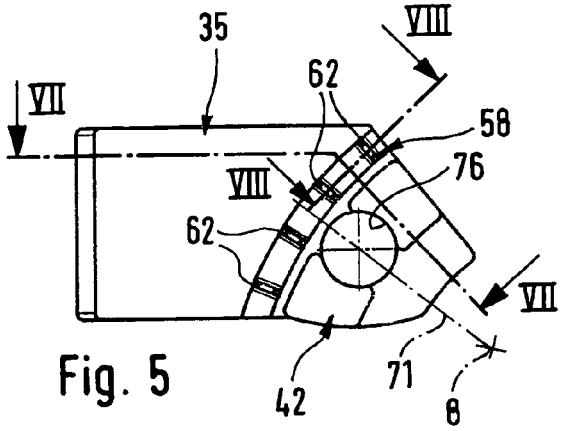
FIG. 5 is a plan view of the bottom side of the counter abutment as in FIG. 4 looking in the direction of the arrow V.

FIG. 5 is a view from below showing a counter abutment 35 near the guide projection 42 which has the hole 76 extending through it for the clamping screw 54 to extend through. It will be see here as well that for the sake of even transfer of force to the anchoring projections 62 it is convenient for the anchoring projections 62 to be partly on one side and partly on the other side of a radial plane 71 which contains the longitudinal axis 8 of the drive shaft 4 and also of the clamping screw. Preferably there is a symmetrical arrangement of the anchoring projections 62 as related to this radial plane 71.

Each counter abutment 34 and 35 preferably has a block-shaped main body 77, on which the previously mentioned means for attachment by clamping of the associated counter abutment 34 and 35 are provided. This main body 77 bears an abutment face 78 extending out toward the abutment arm 32 and which is struck by the abutment arm 32 on reaching the desired angular position.

The abutment face 78 can be component, which is not able to be shifted in relation to the main body 77, of the counter abutment 34 and 35, if all adjustment measures are able to be performed by positioning the counter abutment 34 and 35 in relation to the drive housing 2 or if the pivotal abutment 26 has means for fine adjustment.

Preferably the abutment face 78 is provided on an abutment body 81 which is formed separately from the main body 77 and able to be set generally tangentially to the pivotal movement 33 relative to the main body 77 in order to render possible fine adjustment position to be angularly set for the output shaft 4.

The abutment body 81 is in the working example in the form of an abutment screw screwed into the main body 77 and in which the position set may be held by a lock nut 82. In the case of the abutment body 81 it can be for example also the screwed-in housing of a shock absorber for damping the pivot arm 32 at the end of its stroke.

In order to have a minimum number of anchoring recesses 65 to be produced the anchoring recesses 62 are preferably arranged at a regular pitch. In the case of overlapping abutment positions it is possible, as already mentioned, some of the anchoring recesses present 65 may be multiply used. fine adjustment settings as described it is advantageous in this respect for the distance between sequentially following anchoring projections 62 to be equal at a maximum to the adjustment range of the abutment body 81. In the case of changes in the abutment position it is accordingly possible to take as a basis the pitch of the anchoring projections 65 already made in order to reposition the main body 77 in steps in accordance with such pitch or grid, it being possible to cope with the intermediate range by fine adjustment using the abutment body 81. So when consequently the counter abutments 34 and 35 have been clamped in different abutment positions, for any multiple repositioning no further anchoring recesses 65 will have to be produced and use may be made of the ones already existing.

The invention claimed is:

1. A fluid operated rotary drive comprising a drive housing and an output shaft able to be driven in relation to it by fluid force to perform a reciprocating rotary movement about its longitudinal axis and furthermore a pivotal abutment kinematically coupled with the output shaft and cooperating with at least one counter abutment extending into its path of pivoting for limiting the angular movement of the output shaft in an adjustable manner, said counter abutment being able to be positioned around the longitudinal axis of the output shaft in different abutment positions and able to be clamped by a clamping means in a releasable manner against a clamping face of the housing, said clamping face extending at least for some distance around the longitudinal axis of the output shaft, wherein the at least one counter abutment has an anchoring structure having at least one anchoring projection wherein opposite to such anchoring structure an anchoring face fixedly connected with the drive housing and extending at least for some distance around the longitudinal axis of the output shaft is present which prior to initial fitting of the at least one counter abutment is smooth and wherein on clamping the counter abutment the anchoring structure is able to bite into such anchoring face with the formation of a permanent recess structure having at least one anchoring recess.

2. The rotary drive as set forth in claim 1, wherein the at least one anchoring projection is in the form of an anchoring tooth extending athwart the curved longitudinal axis of the anchoring face.

3. The rotary drive as set forth in claim 1, wherein the anchoring structure comprises a plurality of anchoring projections arranged following each other in the curved longitudinal direction of the anchoring face.

4. The rotary drive as set forth in claim 3, wherein the plurality of anchoring projections are so arranged in the curved longitudinal direction of the anchoring face at a distance apart from each other that there is a clearance between the foot sections of sequentially following anchoring projections.

5. The rotary drive as set forth in claim 4, wherein between the foot sections of neighboring anchoring projections, there is a face parallel to the opposite anchoring face.

6. The rotary drive as set forth in claim 1, wherein the counter abutment has a support face which in the braced condition due to the clamping means bears against the clamping face on the housing and is parallel to the clamping face the anchoring structure projecting past such support face toward the anchoring face.

7. The rotary drive as set forth in claim 1, wherein the anchoring structure extends from a base face of the counter abutment so arranged that in the clamped condition of the counter abutment a free space is left between the base face and the anchoring face, opposite thereto, such free space having the at least one anchoring projection extending through it.

8. The rotary drive as set forth in claim 7, the base face is set back in relation to the support face.

9. The rotary drive as set forth in claim 1, wherein the base face is the base face of a circularly arcuate groove having the at least one anchoring projection extending out from it.

10. The rotary drive as set forth in claim 1, wherein the clamping face extends, as related to the longitudinal axis of the output shaft, radially outside and/or radially inside the anchoring face.

11. The rotary drive as set forth in claim 10, wherein the clamping face and the anchoring face are arranged concentrically to each other and centered on the longitudinal axis of the output shaft.

12. The rotary drive as set forth in claim 1, wherein the at least one counter abutment is arranged to slide on a circularly arcuate guide means of the housing extending at least for some distance about the longitudinal axis of the output shaft.

13. The rotary drive as set forth in claim 12, wherein the guide means is constituted by a circularly arcuate superficial recess (37) which is axially open toward the at least one counter abutment, the at least one counter abutment having its guide projection, which projects from its bottom side, extending into the superficial recess.

14. The rotary drive as set forth in claim 13, wherein the anchoring face as related to the longitudinal axis of the output shaft is arranged at a radial distance from the opening of the superficial recess so that between the anchoring recesses, produced on clamping the counter abutment, and the superficial recess a smooth edge face is left.

15. The rotary drive as set forth in claim 1, wherein the clamping means has a clamping screw extending through the counter abutment and held in a thread in the housing.

16. The rotary drive as set forth in claim 15, wherein the clamping screw extends through the guide projection.

17. The rotary drive as set forth in claim 15, wherein the thread is a part of a lock nut supported in the superficial recess.

18. The rotary drive as set forth in claim 15, wherein the anchoring structure has several anchoring projections arranged in the longitudinal direction of the anchoring face partly on the one side and partly on the other side of a radial plane containing the longitudinal axis of the output shaft and the longitudinal axis of the clamping screw.

19. The rotary drive as set forth in claim 15, wherein the pivotal abutment has an abutment arm extending like a wing away from the output shaft radially, such arm cooperating with the at least one counter abutment.

20. The rotary drive as set forth in claim 1, wherein at least one counter abutment has a main body bearing the anchoring structure and any support face present and furthermore an abutment body cooperating with the pivotal abutment and borne by the main body.

21. The rotary drive as set forth in claim 20, wherein characterized in that the abutment body (81) may be set in position and is designed for fine adjustment of the desired angular position of the output shaft (4) in relation to the main body (77).

22. The rotary drive as set forth in claim 21, wherein in the case of an anchoring structure having several anchoring projections, there is a regular spacing between the individual anchoring projections, said spacing being at the most equal to the adjustment range of the abutment body.

23. The rotary drive as set forth in claim 1, wherein the anchoring structure is made of steel and the anchoring face is made of aluminum material.

24. The rotary drive as set forth in claim 1, wherein two independently positionable counter abutments are present for limiting the angular position of the output shaft in both directions of rotation.

* * * * *